United States Patent [19]

Kimura et al.

[11] 4,324,933

[45] Apr. 13, 1982

[54] ELECTRICAL INSULATING OIL COMPOSITIONS

[75] Inventors: Shoji Kimura, Chigasaki; Noboru Ishida, Sagamihara; Midori Masunaga, Tokyo; Yoshiki Kohno, Kawasaki, all of Japan

[73] Assignee: Nippon Oil Co., Ltd., Tokyo, Japan

[21] Appl. No.: 162,565

[22] Filed: Jun. 24, 1980

Related U.S. Application Data

[63] Continuation of Ser. No. 863,189, Dec. 22, 1977, abandoned, which is a continuation-in-part of Ser. No. 791,280, Apr. 27, 1977, abandoned.

[30] Foreign Application Priority Data

May 1, 1976 [JP] Japan ..... 51-49405

[51] Int. Cl.[3] ..... H01B 3/22; C10G 39/00

[52] U.S. Cl. ..... 585/6.6; 208/14; 252/71; 252/571; 585/10; 585/12

[58] Field of Search ..... 208/14; 252/63, 66, 252/71, 571; 585/6.6, 10

[56] References Cited

U.S. PATENT DOCUMENTS

| | | | |
|---|---|---|---|
| 3,095,366 | 6/1963 | Schieman | 208/14 |
| 3,715,302 | 2/1973 | Mills et al. | 208/14 |
| 3,925,220 | 12/1975 | Mills | 208/14 |
| 4,033,854 | 7/1977 | Ohmori et al. | 208/14 |
| 4,069,165 | 1/1978 | Masunaga et al. | 208/14 |
| 4,070,297 | 1/1978 | Masunaga et al. | 208/14 |

*Primary Examiner*—Curtis R. Davis

*Attorney, Agent, or Firm*—Jordan and Hamburg

[57] ABSTRACT

An electrical insulating oil composition consisting essentially of 50–85 parts by weight of a paraffinic or mixed base crude oil-derived electrical insulating oil, 50–15 parts by weight of a naphthenic base crude oil-derived electrical insulating oil, and 0.001–1.0% by weight of a hydrocarbon-derived pour point depressant, based on the total weight of said two oils.

14 Claims, No Drawings

ELECTRICAL INSULATING OIL COMPOSITIONS

This application is a continuation of application Ser. No. 863,189, filed Dec. 22, 1977 which is a continuation in part of application Ser. No. 791,280, filed Apr. 27, 1977, both of which are now abandoned.

This invention relates to a mineral oil-derived electrical insulating oil having improved pour point.

Electrical insulating oils of mineral oil origin have heretofore generally been produced from a naphthenic base crude oil as the starting oil. It has recently been expected to produce from a mixed or paraffinic base crude oil which is available at a relatively low cost in large quantities. However, electrical insulating oils of mixed or paraffinic crude oil origin are disadvantageous in that they have a high pour point.

This invention is applicable to the elimination of said disadvantage and to the improvement in pour point of electrical insulating oils produced from a paraffinic or mixed base crude oil as the starting oil.

The electrical insulating oil composition of this invention consists essentially of (I) 50–85 parts by weight of an electrical insulating oil produced from a mixed or paraffinic base crude oil as the starting oil, (II) 50–15 parts by weight of an electrical insulating oil produced from a naphthenic base crude oil as the starting oil and (III) 0.001–1.0% by weight of a hydrocarbon-derived pour point depressant, based on the total weight of the oils (I) and (II). Thus, this invention is based on the finding or discovery that the addition of both the oil (II) and oil (III) to the oil (I) exhibits such an unexpectedly great pour point-depressing action on the oil (I) as may not be expected from the addition of the oil (II) alone or the oil (III) alone to the oil (I).

The naphthenic base crude oil used herein is one containing naphthenic hydrocarbons in large proportions and more particularly the crude oil is such that its first key fraction (kerosene fraction) has an API specific gravity of not greater than 33° and its second key fraction (lubricating oil fraction boiling at 275°–300° C. at a reduced pressure of 40 mm of mercury) has an API gravity of not greater than 20°. As is described in "Sekiyu Binran (Handbook on Petroleum)" on page 19, 1972 edition published by Sekiyu Shunju Co., Ltd., Japan; typical of the naphthenic base crude oils are a California crude oil, a Texas crude oil, a Mexico crude oil, a Venezuela crude oil and a Duri crude oil.

The paraffinic crude oil used herein is one containing paraffinic hydrocarbons in large proportions and more particularly the crude oil is such that its first key fraction has an API gravity of not small than 40° and its second key fraction has an API specific gravity of not smaller than 30° as is described in said Handbook on Petroleum; typical of the paraffinic base crude oils are a Pennsylvania crude oil, a Minas crude oil and the like.

The mixed base crude oil used herein is one which is qualitatively intermediate between the paraffinic and naphthenic base crude oils and more particularly the mixed base crude oil is such that its first key fraction has an API specific gravity of 33°–40° and its second key fraction an API gravity of 20°–30°; typical of the mixed base crude oils are a Midcontinent crude oil, an Arabia crude oil, a Khafji crude oil and the like.

This invention is applicable to an electrical insulating oil, as a base oil, of naphthenic, mixed or paraffinic origin, as previously mentioned.

As processes for the preparation of electrical insulating oils from mixed or paraffinic base crude oils, the present inventors have already filed a patent application for a process for the preparation of an electrical insulating oil which comprises refining with furfural or other suitable solvents at 50°–100° C. a distillate having a boiling range of 250°–400° C. at atmospheric pressure obtained by the distillation of a paraffinic or mixed base crude oil at atmospheric pressure or by the distillation at a reduced pressure of a button oil obtained by the distillation of the crude oil at atmospheric pressure, to effect a 30–75 wt.% desulfurization thereby obtaining a raffinate, hydrofining the thus obtained oil to remove therefrom 40–90 wt.% of the sulfur contained therein, solvent dewaxing the desulfurized oil and, if desired, successively treating the dewaxed desulfurized oil with clay thereby to obtain the electrical insulating oil having a sulfur content of 0.1–0.35 wt.%, satisfactory oxidation stability, electrical properties and resistance to copper corrosion (Japanese Patent Appln. No. 121521/74 and U.S. Pat. No. 4,008,148), and they have also already filed a patent application for a process for the preparation of an electrical insulating oil having a total sulfur content of not more than 0.35 wt.%, excellent oxidation stability, thermal stability, corona resistance and corrosion resistance which consists essentially of (I) 80–99 parts by weight of a refined oil obtained by solvent refining a distillate contained in a fraction having a boiling range of 230°–430° C. at atmospheric pressure, the fraction being obtained by the distillation of a paraffinic of mixed base crude oil at atmospheric pressure or by the distillation at a reduced pressure of a bottom oil obtained by the distillation of the crude oil at atmospheric pressure, to produce a raffinate, hydrofining the raffinate so produced, solvent dewaxing the thus-hydrofined oil and, if desired, treating the dewaxed hydrofined oil with a solid adsorbent thereby to obtain the refined oil having a sulfur content of no higher than 0.25 wt.% and an aromatic content of from more than 25 wt.% to 35 wt.% and (II) 1–20 parts by weight of a refined oil obtained by treating the lubricating fraction of a mineral oil with a solid adsorbent (Japanese Patent Appln. No. 17480/75 and U.S. patent appln. Ser. No. 656,906, now U.S. Pat. No. 4,072,620).

The mixed or paraffinic base crude oil-derived electrical insulating oil as the component (I) according to this invention is obtained as follows.

A distillate boiling within the range of 230° to 430° C., preferably 250° to 400° C., at atmospheric pressure, obtained by distillation of a mixed or paraffinic base crude oil at atmospheric pressure or by distillation at a reduced pressure of a residual oil produced by distillation of the crude oil at atmospheric pressure, is solvent refined to obtain a raffinate which is hydrofined, solvent dewaxed and, if necessary, treated with a solid adsorbent, thereby to obtain the component (I) the sulphur content of which has been lowered to not more than 0.35 wt.%, preferably 0.05–0.35 wt.% and more preferably 0.1–0.25 wt.%.

Solvents used in the solvent refinement, are those capable of dissolving aromatic compounds selectively and include furfural, liquefied sulphur dioxide and phenol with furfural being particularly preferred. When furfural, for example, is used as the solvent, the extracting temperatures used may be in the range of 50°–100° C., preferably 60°–90° C., and the ratios by volume of furfural to the starting mineral oil may be in the range of 0.3–2.0, preferably 0.5–1.5.

Then the raffinate obtained by the refinement of the starting mineral oil with the solvent is hydrofined and thereafter dewaxed with a suitable solvent to obtain a predetermined or lower pour point on the raffinate so treated. The thus treated raffinate is consecutively treated with clay as required, thereby obtaining the refined oil (I).

The respective operational conditions under which particularly the solvent refining and hydrofining treatments of all the treatments mentioned above are effected, should be determined in combination so that the refined oil (I) to be obtained contains not more than 0.35% by weight of sulphur.

The limitation of the refined oil (I) to not more than 0.35 wt.% in sulphur content is based on a consideration than when used in transformers the resulting electrical insulating oil containing the refined oil (I) having such a low sulphur content will not aggravate "copper blackening" in the transformers which has recently raised a problem. The catalysts which may be used in the hydrofining according to this invention include the oxides of metals of Group IV, Group IB and Group VIII of the Periodic Table, the metal oxides being supported by bauxite, activated carbon, Fuller's earth, diatomaceous earth, zeolite, alumina, silica, silica alumina or the like, as the carrier. These catalysts are usually used after preliminary sulphurization thereof. Typical of the metal oxides are cobalt oxide, molybdenum oxide, tungsten oxide and nickel oxide.

In the practice of this invention there may particularly preferably be used a catalyst consisting of nickel and molybdenum oxides supported on an aluminum oxide-containing carrier, the metal oxides having been preliminary sulphurized. The reaction temperatures in the hydrofining treatment may usually be in the range of about 230°–about 345° C., preferably 260°–320° C. At lower reaction temperatures the reaction rate will be low, while at higher temperatures the oil to be treated will be decomposed whereby the paraffin content is increased, the pour point is somewhat raised and the resulting electrical insulating oil is not desirable in color. The reaction pressures may be at least 25 $Kg/cm^2G$, preferably 25–75 $Kg/cm^2G$ and more preferably 35–45 $Kg/cm^2G$. In addition, the amounts of hydrogen contacted with the oil to be hydrofined may be 100–10,000 $Nm^3/Kl$ of oil, preferably 200–1,000 $Nm^3/Kl$ of oil.

The hydrofining method employed in this invention is one in which hydrogenolysis is very highly inhibited.

As mentioned above, the refined oil (I) which is one essential component of the insulating oil of this invention, is prepared by subjecting the starting mineral oil to the refinement with the above specified solvent and the hydrofining whereby the starting oil is caused to contain sulphur in a predetermined amount which is not more than 0.35 wt.%. However, the omission of the refinement with the solvent will result in the production of electrical insulating oils having remarkably unsatisfactory thermal stability, while the omission of the hydrofining will result in the production of electrical insulating oils having remarkably unsatisfactory electrical properties, thermal stability and the like.

The solvent dewaxing according to this invention is to solidify the waxy substance in the oil for removal therefrom by the use of a known method which is usually the BK method in this case. The dewaxing solvents used herein include a mixed solvent such as benzene-toluene-acetone or benzene-toluene-methyl ethyl ketone. The suitable composition (ratio of ketonic component to aromatic components) may preferably be in the range of about 30–35: about 70–65 for such acetone-containing mixed solvents and about 45–50: about 55–50 for such methyl ethyl ketone-containing ones.

The ratios of the solvent to the oil being dewaxed may be such that the solvent-added oil fed to a dewaxing filter is kept approximately constant in viscosity. The solvent dewaxing treatment according to this invention may be carried out at any stage, particularly preferably at a stage subsequent to the hydrofining step, in the process for the preparation of the electrical insulating oils. If necessary, the thus dewaxed oil may successively be treated with a solid adsorbent. The solid adsorbent treatment stated herein is intended to mean a treatment by which a mineral oil being treated in contacted with a solid adsorbent such as acid clay, activated clay, Fuller's earth, alumina or silica alumina. The contact is usually effected at about 50°–80° C. for about a half hour to several hours. The contact method employed is a percolation, contact or like method.

The naphthenic base crude oil-derived insulating oil as the component (II) of this invention, produced from a naphthenic base crude oil as the starting oil, may be obtained by a conventional known process. Such known processes include a process comprising treating a naphthenic base crude oil with sulphuric acid, a process comprising hydrofining and a process comprising solvent refining and hydrofining.

It is particularly preferable in this invention to use as the component (II) an electrical insulating oil obtained by hydrofining a naphthenic base crude oil and then treating the thus hydrofined oil with a solid adsorbent. Preferably, either a naphthenic base crude oil is distilled at atmospheric pressure or a residual oil obtained by distillation of the crude oil at atmospheric pressure is distilled at a reduced pressure, thereby obtaining a distillate boiling within the range of 250° to 400° C. The distillate so obtained is hydrofined and then treated with a solid adsorbent to obtain the component (II). The treatment with a solid adsorbent may be effected after blending with the component (I) or with the components (I) and (III). The hydrofining and the solid adsorbent treatments may be effected under the same operational conditions as used in the production of the component (I).

The hydrocarbon-derived pour point depressant which is the component (III) according to this invention, is at least one compound selected from (1) a copolymer of ethylene and an α-olefin having the general formula $CH_2{=}CH{-}R$ wherein R is an alkyl group having at least one carbon atom, (2) poly-α-olefin (α-olefin polymer), (3) a hydrogenated, styrene-butadiene copolymer, (4) a condensed alkylnaphthalene and (5) an alkylated polystyrene.

The copolymers (1) of ethylene and α-olefin include ethylene-propylene copolymers, ethylene. butene-1 copolymers and ethylene. hexene-1 copolymers with ethylene-propylene copolymers being particularly preferred. The ethylene. α-olefin copolymers used herein are essentially amorphous oil-soluble ones having a number average molecular weight of usually 10,000–200,000, preferably 20,000–70,000, and an ethylene content of 30–90 mol%, preferably 40–80 mol%. The term "essentially amorphous" used herein means that the ethylene. α-olefin copolymers may have some degree of crystallization therein, the degree being usually 0–5%, preferably 0–2%. In addition, it is preferable that the copolymers have a relatively narrow distribution of molecular weight, the distribution being usually not higher than 8, particularly not higher than 4. The ethylene. α-olefin copolymers may be produced by known processes. The copolymerization may be effected by reacting ethylene with at least one α-olefin in an inert organic solvent containing an organic solvent-soluble specified homogeneous Ziegler type catalyst at atmospheric or somewhat superatmospheric pressure and at a temperature varying from a somewhat low temperature to a somewhat high temperature. The Ziegler type catalyst which may preferably be used is a coordination catalyst comprising a vanadium compound and organoaluminum compound such as $VOCl_3$—$Al(CH_2H_5)$ system.

The poly-α-olefin or polymer of α-olefin (2) usable as the component (III) of this invention is a homopolymer or copolymer of α-olefin having the general formula $CH_2$=CH—R wherein R is any one of alkyl groups which have 7–18, preferably 8–16, carbon atoms and are identical with, or different from, each other at the same time. The polymer of α-olefin (2) may also be a mixture of said homopolymer and copolymer. The polymer or copolymer contains $\leftarrow CH_2 \rightarrow_n$ in which n is at least 6. These polymers of α-olefin may be produced in the presence of the same homogeneous Ziegler type catalyst as the aforesaid ethylene. α-olefin copolymer (1). The polymer of α-olefin has a number average molecular weight of usually 10,000–200,000, preferably 20,000–70,000 and is essentially amorphous; in addition, it should preferably have a relatively narrow molecular weight distribution.

The hydrogenated styrene-butadiene copolymer (3) usable as the component (III) according to this invention may be produced by a known process such as a process comprising copolymerizing styrene and butadiene in the presence of an alkyl-alkali metal compound, such as butyllithium, as a catalyst and hydrogenating the resulting styrene-butadiene copolymer using a known hydrogenating technique. It is desirable that at least 90%, preferably 100%, of the double bonds contained in the original styrene-butadiene copolymer be hydrogenated.

The hydrogenated styrene-butadiene copolymer (3) is preferably a random copolymer and has an average molecular weight of usually 10,000–200,000, preferably 20,000–70,000. The ratio of content between the styrene units and the butadiene units in the copolymer is 15–50:85–50, preferably 25–40:75–60.

The condensed alkylnaphthalene (4) usable as the component (III) is a condensate of dichloroparaffin and naphthalene and may be synthesized by a known process using a catalyst such as anhydrous $AlCl_3$. The dichloroparaffin usable herein is dichloride of a paraffin having about 15–60 carbon atoms. The condensed alkylnaphthalene usable herein has a molecular weight of several thousands to hundred thousands, usually about 2,000–70,000.

The alkylated polystyrene (5) usable as the component (III) according to this invention may be produced by a known process such as a process comprising subjecting styrene to radical polymerization in the presence of a peroxide, such as benzoyl peroxide, as an initiator. Starting polystyrene for the alkylated polystyrene (5) has a number average molecular weight of 10,000–150,000, preferably 20,000–70,000. The starting polystyrene is alkylated by contacting an alkyl halide therewith in the presence of a Friedel-Crafts type catalyst. The alkyl halide is represented by the general formula RX wherein R is an alkyl group having 6–20, preferably 8–18, carbon atoms and X is a halogen atoms.

This invention is based on the finding or discovery that a mixed or paraffinic base crude oil-derived electrical insulating oil (I) may remarkably be depressed in pour point without impairing the electrical properties thereof by adding thereto a naphthenic base crude oil-derived electrical insulating oil (II) and a specified hydrocarbon-derived pour point depressant each in a specified proportion.

According to this invention, the blending ratio by weight of the electrical insulating oil (I) as the 1st component to the electrical insulating oil (II) as the 2nd component may generally be in the range of 50–85:50–15, preferably 50–78:50–22, and more preferably 55–75:45–25. The use of the oil (II) in a higher blending ratio than the oil (I) will not be effective in further improving the oil (I) in properties, particularly pour point. When used in combination with the hydrocarbon-derived pour point depressant (III), the use of the component (II) in a blending ratio lower than said general range will not exhibit a remarkable synergistic depressing effect on the pour point of the component (I) although such remarkable depression is characteristic of this invention. In addition, the hydrocarbon-derived pour point depressant (III) as the third component of the insulating oil composition of this invention may be used in amounts of 0.001—1.0%, preferably 0.05–0.2%, of the total weight of the components (I) and (II).

Furthermore, the electrical insulating oil composition of this invention may be incorporated with a known antioxidant such as DBPC (di-tert.-butyl-p-cresol), N-phenyl-α-naphthylamine, nicotinic acid or hydroquinoline.

This invention will be illustrated by the following non-limitative Examples wherein all percentages and parts are by weight unless otherwise specified.

EXAMPLE 1

There was obtained a distillate having a boiling range of 260°–380° C. at atmospheric pressure and a sulfur content of 2.2 wt.% by distilling an Arabia crude oil at atmospheric pressure to obtain a bottom oil and distilling the thus-obtained bottom oil at a reduced pressure. The distillate so obtained was extracted with furfural in a solvent ratio (furfural/distillate) of 1.3 at an extracting temperature of 75°–90° C. to obtain a raffinate having a sulfur content of 0.8 wt.%. The thus-obtained raffinate was hydrofined at 310° C. under a hydrogen pressure of 40 kg/cm$^2$G in the presence of an alumina-carried NiO-$MoO_3$ catalyst (Nio:3.0 wt.%, $MoO_3$: 14.0 wt.%) to obtain a hydrofined oil which was dewaxed with a benzene-toluene-methyl ethyl ketone mixed solvent in a solvent ratio (solvent/oil) of 1.6 at a cooling temperature of −30° C. and successively treated with clay at 70° C. for one hour thereby obtaining an electrical insulating oil (A).

Separately, a distillate boiling within the range of about 280° to about 390° C., obtained by distillation of Tia Juana crude oil at atmospheric pressure, was hydrofined at a reaction temperature of 335° C., a hydrogen pressure of 40 kg/cm$^2$G and a LHSV of 1.0 in the presence of a molybdenum oxide-nickel oxide catalyst carried on alumina and then treated with activated clay at 60° C. for one hour thereby to obtain an electrical insulating oil (B) having a pour point of −55° C.

Seventy (70) parts of the electrical insulating oil (A) were blended with 30 parts of the electrical insulating oil (B) to obtain an electrical insulating oil (C).

Each of the electrical insulating oils (A) and (C) was incorporated with an amorphous ethylene-propylene copolymer (PPD-(1)) having an average molecular weight of about 36,000 and a propylene content of 40 mol%, thereby to obtain electrical insulating oils.

The insulating oils so obtained had the properties as shown in Table 1.

TABLE 1

| | | Ex. 1 | | | | Ex. 2 | | Ex. 3 | | Ex. 4 | |
|---|---|---|---|---|---|---|---|---|---|---|---|
| | | Electrical Insulating Oil (A) | Electrical Insulating Oil (C) | Electrical Insulating Oil (D) | Electrical Insulating Oil (E) | Electrical Insulating Oil (F) | Electrical Insulating Oil (G) | Electrical Insulating Oil (H) | Electrical Insulating Oil (I) | Electrical Insulating Oil (J) | Electrical Insulating Oil (K) |
| Composition (weight) | Electrical insulating oil (A) | 100 | 70 | 100 | 70 | 100 | 70 | 100 | 70 | 100 | 70 |
| | Electrical insulating oil (B) | | 30 | | 30 | | 30 | | 30 | | 30 |
| | PPI-(1) | | | 0.07 | 0.07 | | | | | | |
| | PPD-(2) | | | | | 0.1 | 0.1 | | | | |
| | PPD-(3) | | | | | | | 0.1 | 0.1 | | |
| | PPD-(4) | | | | | | | | | 0.1 | 0.1 |
| Pour Point °C. | | −25 | −27.5 | −32.5 | −47.5 | −32.5 | −45 | −32.5 | −47.5 | −30 | −42.5 |
| Volume resistivity 80° C., Ω . cm | | $3.7 \times 10^{15}$ | $2.5 \times 10^{15}$ | $3.1 \times 10^{15}$ | $2.1 \times 10^{15}$ | $3.8 \times 10^{15}$ | $2.0 \times 10^{15}$ | $3.9 \times 10^{15}$ | $2.8 \times 10^{15}$ | $1.9 \times 10^{15}$ | $1.9 \times 10^{15}$ |
| Dielectric loss tangent 80° C., | | 0.005 | 0.007 | 0.006 | 0.007 | 0.006 | 0.007 | 0.005 | 0.008 | 0.009 | 0.008 |
| Copper corrosion (ASTM D 1275) | | 1b | 1b | 1b | 1b | 1b | 1b | 1b | 1b | 2a | 2a |
| Steam emulsion number (JIS K-2517) | | 35 | 41 | 39 | 40 | 40 | 43 | 33 | 37 | 39 | 40 |

EXAMPLE 2

Each of the electrical insulating oils (A) and (C) as obtained in Example 1 was incorporated with a compound (PPD-(2)) obtained by hydrogenating a styrene-butadiene copolymer having an average molecular weight of about 40,000 and a styrene content of 32 mol % to the extent that at least 95% of double bonds of the butadiene units has been hydrogenated. The electrical insulating oils so obtained had the properties as shown in Table 1.

EXAMPLE 3

Each of the electrical insulating oils (A) and (C) was incorporated with an alkylated polystyrene (PPD-(3)) obtained by reacting a polystyrene having an average molecular weight of 25,000 with dodecyl chloride in the presence of aluminum chloride as the catalyst. The electrical insulating oils thus obtained had the properties as indicated in Table 1.

EXAMPLE 4

The electrical insulating oils (A) and (C) as obtained in Example 1 were each incorporated with a condensed alkylnaphthalene having an average molecular weight of about 12,000, obtained by subjecting dichloride of paraffin having about 30 carbon atoms and naphthalene to condensing reaction in the presence of anhydrous aluminum chloride as the catalyst. The electrical insulating oils so obtained has the properties as shown in Table 1.

As is apparent from Table 1, the electrical insulating oil obtained by adding the electrical insulating oil (B) alone or the pour point depressant alone to the electrical insulating oil (A), exhibited slight pour point depression, while the electrical insulating oil obtained by adding both the insulating oil (B) and the pour point depressant to the insulating oil (A) exhibited remarkable pour point depression.

What is claimed is:

1. An electrical insulating oil composition consisting essentially of (I) 50–85 parts by weight of a mixed or paraffinic base crude oil-derived electrical insulating oil having a sulphur content of not higher than 0.35 wt.% and being obtained by the steps of:

refining with a solvent a distillate boiling within the range of 230° to 430° C. at atmospheric pressure, the distillate being obtained by distillation of a mixed or paraffinic base crude oil at atmospheric pressure or by distillation at a reduced pressure of a residual oil produced by distillation of the crude oil at atmospheric pressure, to obtain a raffinate, hydrofining the thus obtained raffinate and solvent dewaxing the thus hydrofined raffinate, (II) 50–15 parts by weight of a naphthenic base crude oil-derived insulating oil, and (III) of 0.001–1.0% by weight of a hydrocarbon derived pour point depressant, based on the total weight of the oils (I) and (II), selected from the group consisting of (1) copolymers of ethylene and α-olefin having the general formula $CH_2{=}CH{-}R$ wherein R is an alkyl group having at least one carbon atom, (2) polymers of α-olefin having the general formula $CH_2{=}CH{-}R$ wherein R is any one of $C_{7\text{-}18}$ alkyl groups which are identical with, or different from, each other, the polymers containing $\text{+}CH_2\text{+}_n$ wherein n is at least 6, (3) styrene-butadiene copolymers in hydrogenated form, and (4) alkylated polystyrenes obtained by the reaction of a polystyrene having a number average molecular weight of 10,000–150,000 with an alkyl halide of the formula RX wherein R is an alkyl group having 6–20 carbon atoms and X is a halogen atom.

2. An electrical insulating oil composition according to claim 1, wherein the electrical insulating oil (I) is further treated with a solid adsorbent.

3. An electrical insulating oil composition according to claim 1, wherein the naphthenic base crude oil-derived insulating oil (II) is one boiling within the range of 250° to 400° C. and being obtained by the steps of:

hydrofining a distillate boiling within the range of 250° to 400° C. obtained by distillation of a naphthenic base crude oil at atmospheric pressure or by distillation at a reduced pressure of a residual oil obtained by distillation of the crude oil at atmospheric pressure, and treating the thus hydrofined distillate with a solid adsorbent.

4. An electrical insulating oil composition according to claim 3, wherein the hydrocarbon-derived pour point depressant (III) is at least one member selected from the group consisting of (1) copolymers of ethylene and α-olefin having the general formula $CH_2{=}CH{-}R$ wherein R is an alkyl group having at least one carbon atom, (2) polymers of α-olefin having the general formula $CH_2{=}CH{-}R$ wherein R is any one of $C_{7\text{-}18}$ alkyl groups which are identical with, or different from, each other, the polymers containing $\text{-}(CH_2)_n\text{-}$ wherein n is at least 6, (3) styrene-butadiene copolymers in hydrogenated form, (4) condensed alkylnaphthalenes obtained by the condensation of dichloroparaffin and naphthalene and (5) alkylated polystyrenes obtained by the reaction of a polystyrene having a number average molecular weight of 10,000-150,000 with an alkyl halide of the formula RX wherein R is an alkyl group having 6-20 carbon atoms and X is a halogen atom.

5. An electrical insulating oil composition according to claim 3, wherein the electrical insulating oil (I) is further treated with a solid adsorbent.

6. An electrical insulating oil composition according to claim 4, wherein the electrical insulating oil (I) is further treated with a solid adsorbent.

7. An electrical insulating oil composition according to claim 1, wherein the electrical insulating oil (I) is present in an amount of 55-75 parts by weight and insulating oil (II) is present in an amount of 45-25 parts by weight.

8. The process of providing an improved electrical insulating oil comprising blending: (I) 50-85 parts by weight of a mixed or paraffinic base crude oil-derived electrical insulating oil having a sulphur content of not higher than 0.35 wt.% and being obtained by the steps of:

refining with a solvent a distillate boiling within the range of 230° to 430° C. at atmospheric pressure, the distillate being obtained by distillation of a mixed or paraffinic base crude oil at atmospheric pressure or by distillation at a reduced pressure of a residual oil produced by distillation of the crude oil at atmospheric pressure, to obtain a raffinate, hydrofining the thus obtained raffinate, and solvent dewaxing the thus hydrofined raffinate, (II) 50-15 parts by weight of a naphthenic base crude oil-derived insulating oil, and (III) 0.001-1.0% by weight of a hydrocarbon derived pour point depressant, based on the total weight of the oils (I) and (II).

9. An electrical insulating oil composition according to claim 1, wherein said distillate is refined with the solvent to remove 30-75 wt.% of the sulphur contained therein.

10. An electrical insulating oil composition according to claim 1, wherein said raffinate is hydrofined to remove 40-90 wt.% of the sulphur contained therein.

11. An electrical insulating oil composition according to claim 1, wherein said mixed or paraffinic base crude oil-derived electrical insulating oil has a sulphur content of 0.05-0.35 wt.%.

12. An electrical insulating oil composition consisting essentially of:

(I) 50-85 parts by weight of a mixed-base crude oil-derived electrical insulating oil having a sulphur content of not higher than 0.35 wt.% and being obtained by the steps of:

refining with furfural a distillate boiling at 260°-380° C. at atmospheric pressure, the distillate being obtained by distillation of crude oil at atmospheric pressure and then by distillation at reduced pressure of the residual oil from the first distillation, to obtain a raffinate, hydrofining the thus obtained raffinate and solvent dewaxing the thus hydrofined raffinate;

(II) 50-15 parts by weight of a naphthenic base crude oil-delivered insulating oil wherein the latter boils within the range of 280° to 390° C. and is obtained by:

hydrofining a distillate boiling within said latter range obtained by distillation of crude oil at atmospheric pressure, and treating the thus hydrofined distillate with activated clay;

and (III) 0.001—1.0% by weight of an amorphous ethylene-prophylene copolymer with an average molecular weight of about 36,000 and a propylene content of 40 mol.%.

13. An electrical insulating oil composition consisting essentially of:

(I) 50-85 parts by weight of a mixed-base crude oil-derived electrical insulating oil having a sulphur content of not higher than 0.35 wt.% and being obtained by the steps of:

refining the furfural a distillate boiling at 260°-380° C. at atmospheric pressure, the distillate being obtained by distillation of crude oil at atmospheric pressure and then by distillation at reduced pressure of the residual oil from the first distillation, to obtain a raffinate, hydrofining the thus obtained raffinate and solvent dewaxing the thus hydrofined raffinate;

(II) 50-15 parts by weight of a naphthenic base crude oil-delivered insulating oil wherein the latter boils within the range of 280° to 390° C. and is obtained by:

hydrofining a distillate boiling within said latter range obtained by distillation of crude oil at atmospheric pressure, and treating the thus hydrofined distillate with activated clay;

and (III) 0.001-1.0% by weight of a styrene-butadiene copolymer, with an average molecular weight of about 40,000 and a styrene content of about 32 mol% and which is hydrogenated to the extent that at least 95% of the double bonds of the butadiene units have been hydrogenated.

14. An electrical insulating oil composition consisting essentially of:

(I) 50-85 parts by weight of a mixed-base crude oil-derived electrical insulating oil having a sulphur content of not higher than 0.35 wt.% and being obtained by the steps of:

refining the furfural a distillate boiling at 260°-380° C. at atmospheric pressure, the distillate being obtained by distillation of crude oil at atmospheric pressure and then by distillation at reduced pressure of the residual oil from the first distillation, to obtain a raffinate, hydrofining the thus obtained raffinate and solvent dewaxing the thus hydrofined raffinate;

(III) 50-15 parts by weight of a naphthenic base crude oil-derived insulating oil wherein the latter boils within the range of 280° to 390° C. and is obtained by:

hydrofining a distillate boiling within said latter range obtained by distillation of crude oil at atmospheric pressure, and treating the thus hydrofined distillate with activated clay;

and (III) 0.001—1.0% by weight of an alkylated polystyrene obtained by reacting a polystyrene with an average molecular weight of about 25,000 with dodecyl chloride in the presence of aluminum chloride.

* * * * *